United States Patent [19]

Bellicardi

[11] 4,181,108

[45] Jan. 1, 1980

[54] SYSTEM FOR THE CONTROL OF THE COMPOSITION OF THE FUEL-AIR MIXTURE OF AN INTERNAL COMBUSTION ENGINE

[75] Inventor: Francesco Bellicardi, Bologna, Italy

[73] Assignee: Edoardo Weber - Fabbrica Italiana Carburatori S.p.A., Bologna, Italy

[21] Appl. No.: 875,710

[22] Filed: Feb. 6, 1978

[30] Foreign Application Priority Data

Feb. 7, 1977 [IT] Italy ..... 3343 A/77

[51] Int. Cl.[2] ..... F02M 11/00

[52] U.S. Cl. ..... 123/119 EC; 60/276; 261/42

[58] Field of Search ..... 123/119 EC; 60/276, 60/285; 261/42, 43, 50 R

[56] References Cited

U.S. PATENT DOCUMENTS

| | | | |
|---|---|---|---|
| 2,909,031 | 10/1959 | Kiekhaefer | 123/198 E |
| 3,906,910 | 9/1975 | Szlaga, Jr. | 123/119 EC |
| 4,072,137 | 2/1978 | Hattori et al. | 123/119 EC |
| 4,084,563 | 4/1978 | Hattori et al. | 123/119 EC |
| 4,085,176 | 4/1978 | Minami | 123/119 EC |
| 4,094,273 | 6/1978 | Hattori et al. | 123/119 EC |
| 4,103,657 | 8/1978 | Minami | 123/119 EC |
| 4,114,372 | 9/1978 | Ikeura | 123/119 EC |
| 4,114,578 | 9/1978 | Hattori et al. | 123/119 EC |

FOREIGN PATENT DOCUMENTS

| | | | |
|---|---|---|---|
| 2315012 | 1/1977 | France | 123/198 E |

*Primary Examiner*—Charles J. Myhre
*Assistant Examiner*—R. A. Nelli
*Attorney, Agent, or Firm*—Sughrue, Rothwell, Mion, Zinn and Macpeak

[57] ABSTRACT

The system is comprised of an electromagnetically operated valve for controlling the supply of air to the main and idle ducts of each carburetor stage to vary the fuel-air mixture in response to a signal from an oxygen concentration probe disposed upstream of the catalytic converter in the exhaust system of an internal combustion engine. The device is mounted on the vehicle structure rather than the engine and is comprised of a rotary cam disposed in operative relation with the plurality of metering valves to control the air supply from a single conduit leading from the air filter to a plurality of conduits leading to the various carburetor ducts.

1 Claim, 18 Drawing Figures

FIG. 1
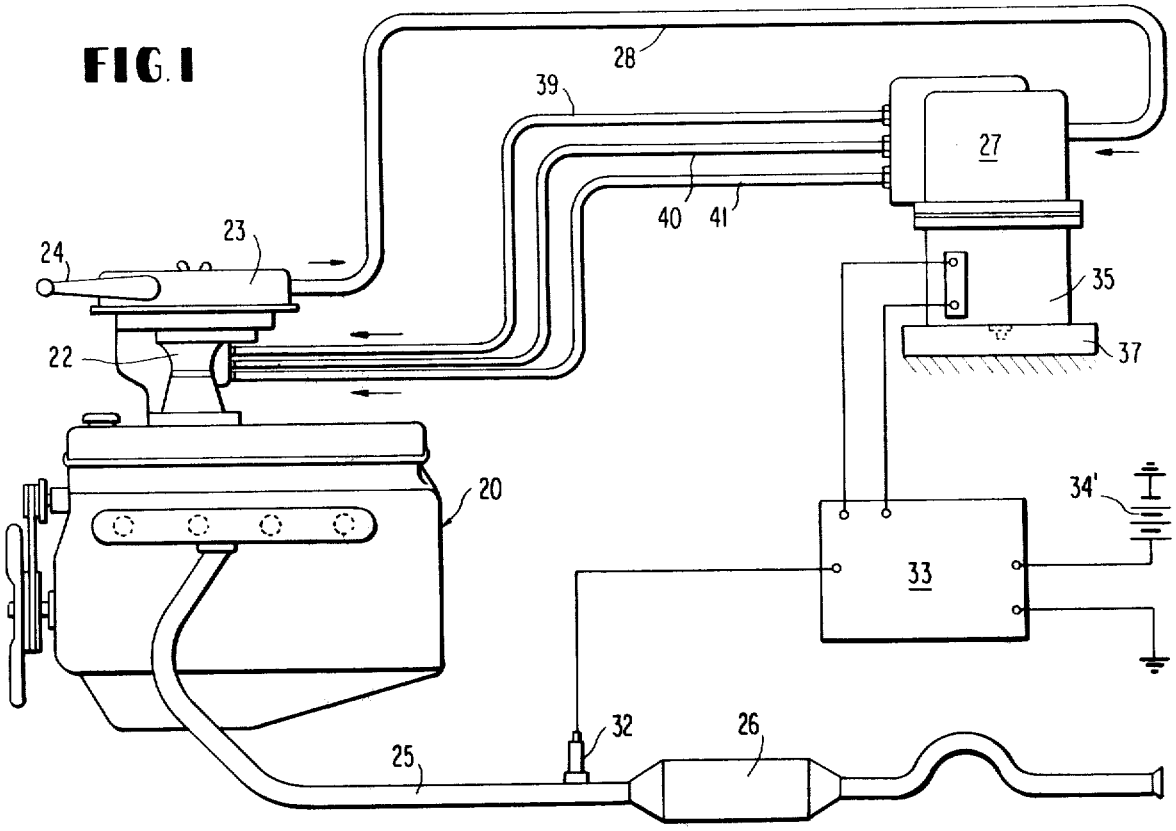
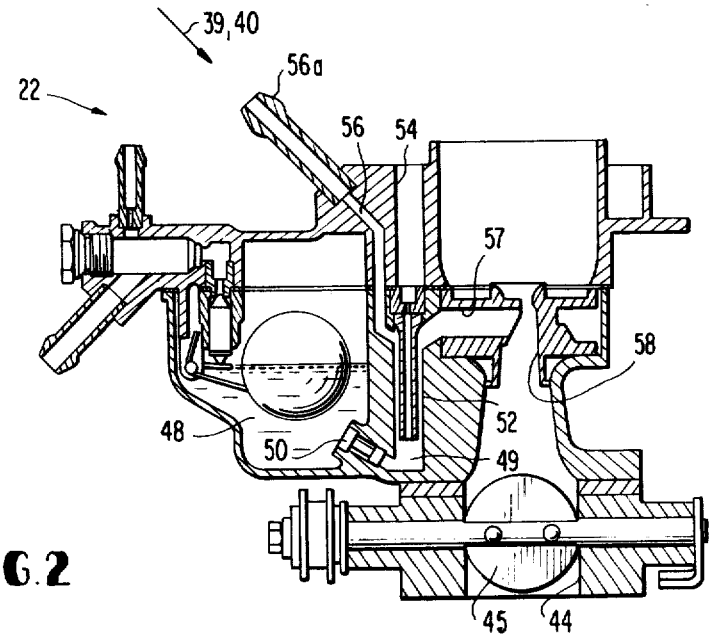
FIG. 2

FIG. 3
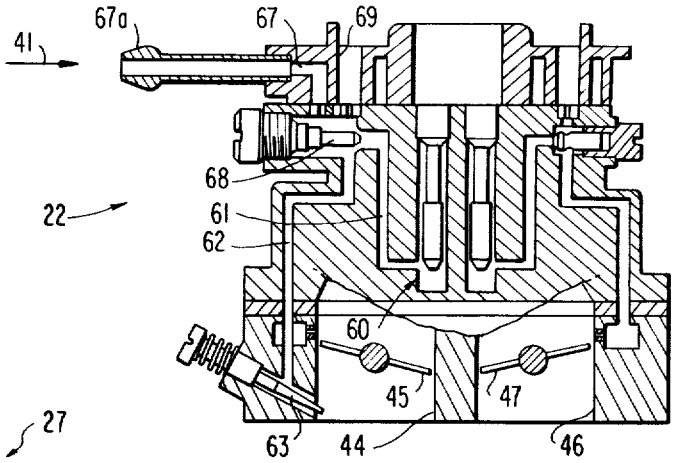
FIG. 4
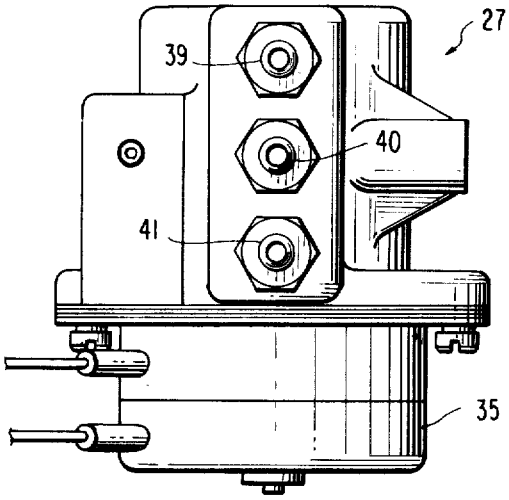
FIG. 5
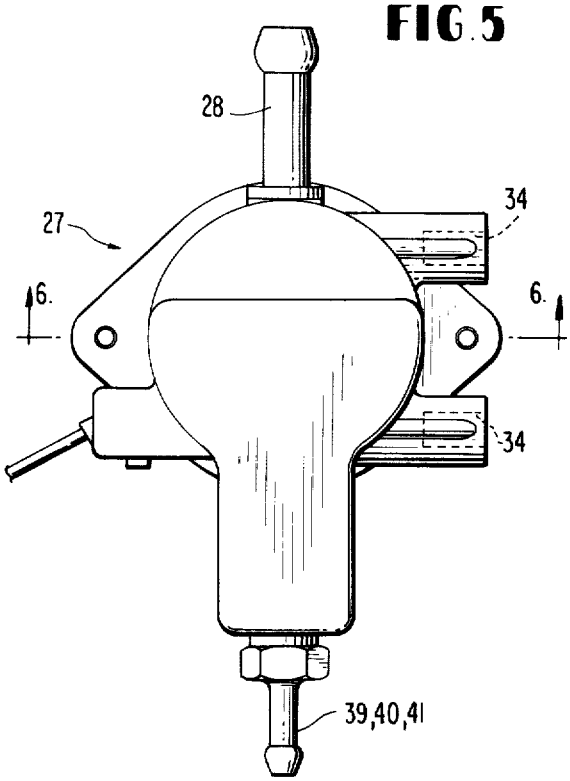
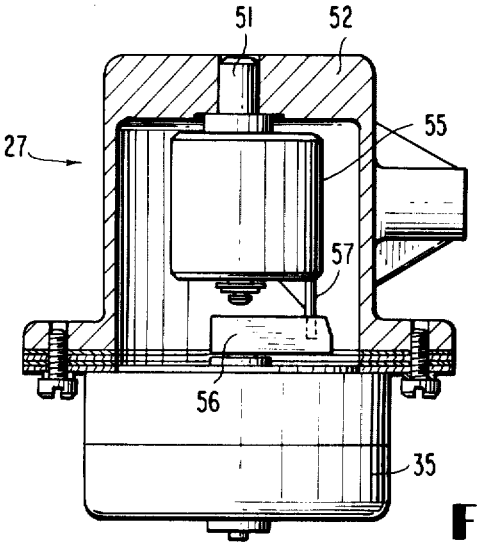
FIG. 6

FIG. 7
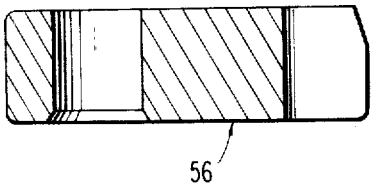
FIG. 9
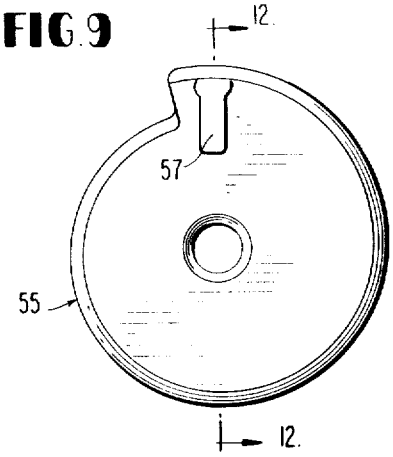
FIG. 8
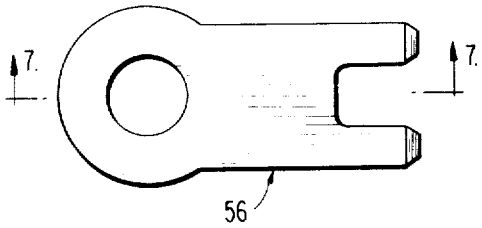
FIG. 10
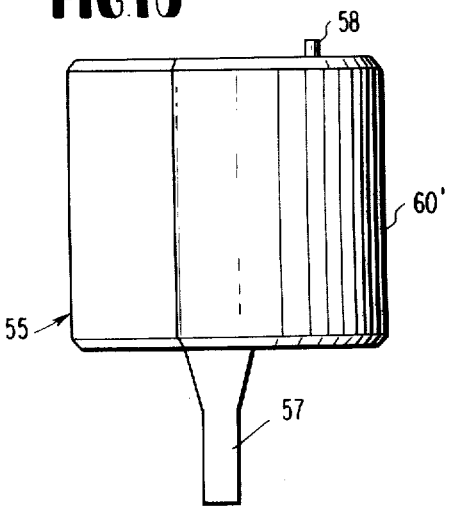
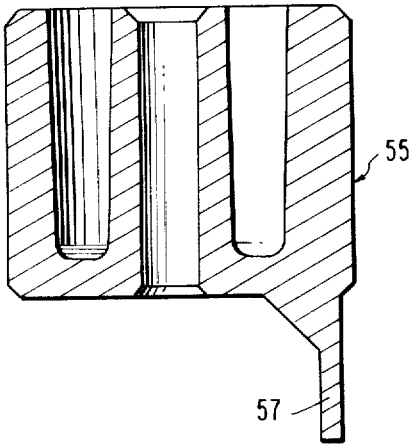
FIG. 12
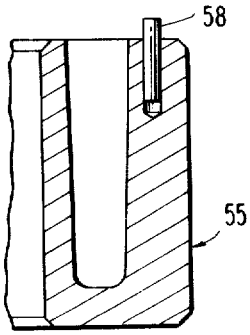
FIG. 11

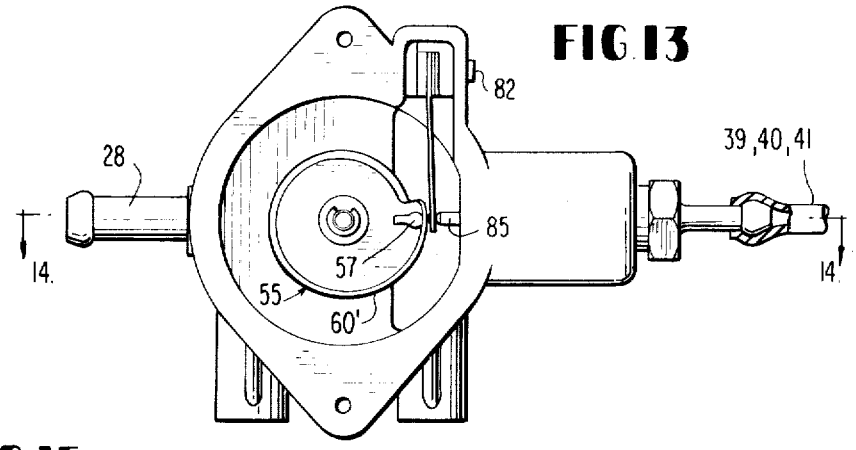
FIG. 13
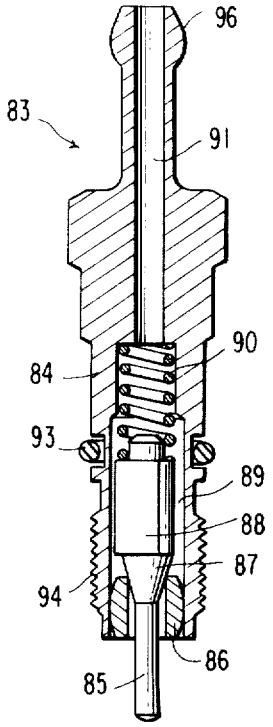
FIG. 15
FIG. 14
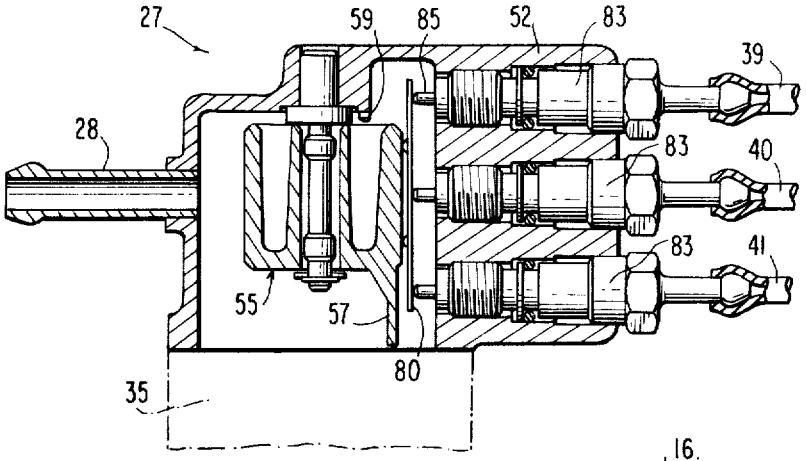
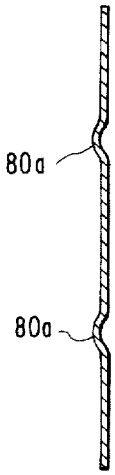
FIG. 16
FIG. 17
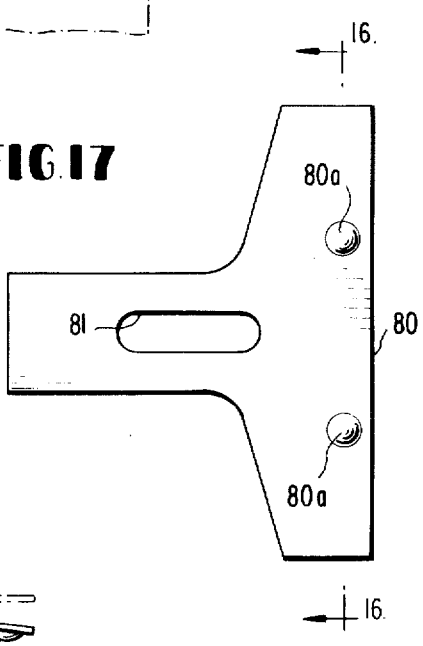
FIG. 18
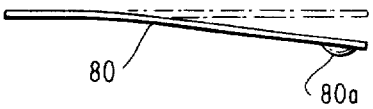

SYSTEM FOR THE CONTROL OF THE COMPOSITION OF THE FUEL-AIR MIXTURE OF AN INTERNAL COMBUSTION ENGINE

BACKGROUND OF THE INVENTION

1. Field of the Invention

The present invention is directed to a system designed to correct the fuel-air ratio delivered by a carburetor for an internal combustion engine with the object of maintaining an optimum ratio under all working conditions of the engine.

2. Prior Art

Various systems for providing the best possible control or regulation of the fuel-air ratio for an internal combustion engine as a function of the operating conditions of the engine have been proposed in order to reduce the harmful components such as nitrous oxides, carbon monoxide and the hydrocarbons which are in the exhaust gases. Some of these systems utilize an electronic control circuit which is based upon the measured concentration of one constituent or component of the engine exhaust gases and, in turn, provide an electric control signal for a metering device associated with the carburetor to control the supply of fuel and/or air to the internal combustion engine. By incorporating such metering devices or correction devices for adjusting the fuel-air ratio directly in the carburetor, it is difficult to maintain such devices in proper adjustment and often times such devices are subject to damage due to the vibrations induced by the engine.

In the known prior art systems incorporating the above-mentioned metering or correction devices, the metering only takes places with respect to the fuel or the air and such metering is only associated with a single duct of the carburetor.

SUMMARY OF THE INVENTION

The system according to the present invention is capable of delivering a fuel-air mixture to the carburetor according to the criteria of maximum economy and maximum power.

The system according to the present invention eliminates the adverse influence of engine vibrations to the metering device for controlling the fuel-air ratio by supporting the metering device upon vehicle structure which is less subject to engine vibrations.

The system according to the present invention provides a simultaneous air metering function for one or more ducts of each stage of the carburetor so that the proper fuel-air ratio will be maintained under all operating conditions of the engine.

The system according to the present invention is comprised of an air filter, at least one carburetor, an internal combustion engine, an exhaust system for the gases produced by the combustion of the fuel-air mixture supplied by said carburetor, a sensor for detecting the composition of the exhaust gases, and electronic processor which processes the signal emitted by said sensor and a stepping motor responsive to the signal provided by said electronic processor for operating the metering device to control the air being supplied to the carburetor wherein said metering device is supported by a portion of the vehicle structure which is less exposed to the vibrations produced by the engine than the carburetor. The metering device supplies air through a conduit to the upper portion of the emulsifier tube of the carburetor. According to the present invention, additional conduits are provided from the metering device for controlling the air delivered to the idling system as well as the main system of each carburetor.

The foregoing and further objects, features and advantages of the present invention will be apparent from the following more particular description of the preferred embodiment of the invention as illustrated in the accompanying drawings.

BRIEF DESCRIPTION OF THE DRAWINGS

FIG. 1 is a schematic view of the system according to the present invention. FIG. 2 is a sectional view of a two-stage carburetor having a controlled air supply to each main duct in accordance with the present invention.

FIG. 3 is a sectional view of a two-stage carburetor having a controlled air supply to one of the idle ducts in accordance with the present invention.

FIG. 4 is a side elevational view of the air metering device according to the present invention.

FIG. 5 is a top plan view of the air metering device shown in FIG. 4.

FIG. 6 is a partial sectional view of the metering device taken along the line 6—6 of FIG. 5.

FIG. 7 is a sectional view of the driving lever taken along the line 7—7 in FIG. 8.

FIG. 8 is a plan view of a driving lever for imparting drive from the motor to the cam in the metering device.

FIG. 9 is an end view of the cam of the metering device according to the present invention.

FIG. 10 is a top plan view of the cam shown in FIG. 9.

FIG. 11 is a partial sectional view of the cam in FIG. 10 showing the stop pin.

FIG. 12 is a sectional view of the cam taken along the line 12—12 in FIG. 9.

FIG. 13 is a bottom plan view of the metering device with the motor removed.

FIG. 14 is a partial sectional view of the metering device taken along the line 14—14 in FIG. 13 with the location of the motor shown in dotted lines.

FIG. 15 is a partial sectional view of one of the metering valves of the metering device.

FIG. 16 is a sectional view of the cam follower plate taken along the line 16—16 in FIG. 17.

FIG. 17 is a plan view of the cam follower plate.

FIG. 18 is a side view of the cam follower plate of FIG. 17.

DETAILED DESCRIPTION OF THE INVENTION

The system as shown in FIG. 1 is comprised of an internal combustion engine 20 having a carburetor 22 surmounted by an air filter 23 having an intake 24. The exhaust gases are removed from the engine 20 through the conduit 25 and pass through a catalytic converter 26 before being discharged into the atmosphere. In order for the catalytic converter to operate efficiently, the concentration of the combustion products should be maintained within certain limits corresponding to a stoichiometric metering of the fuel-air mixture supplied by the carburetor.

In order to achieve the stoichiometric metering of the fuel-air mixture, a metering device 27 is inserted into the air supply system for the carburetor. Fresh clean air is supplied from the air filter 23 to the metering device 27 through the conduit 28. A probe 32 sensitive to the concentration of oxygen in the discharge gases is arranged in the discharged conduit 25 upstream of the converter 26. The probe 32 is electrically connected to an electronic control unit 33 which is supplied with power by the standard battery 34' of the motor vehicle. The electronic control unit 33 is connected to a stepping motor 35 which is operatively connected to the metering device 27. The circuitry within the control unit 33 which supplies a control signal to the motor 35 in response to the signal received from the probe 32 is conventional and well known in the art and does not form a part of the present invention. When the probe 32 transmits a signal to the electronic unit 33 indicating that the oxygen concentration in the discharge gases is not that corresponding to the stoichiometric ratio of the fuel-air mixture, the control unit 33 sends a signal to the electric motor 35 for controlling the metering device 27 in such a manner as to bring the fuel-air ratio to the stoichiometric value. The probe 32 is of the solid state electrolyte type and is also conventional in the art.

In order to achieve the optimum operating conditions for the motor 35 and metering device 27 and to prevent damage to the motor driven metering device 27 as a result of engine vibrations, the motor driven metering device 27 is mounted on a portion of the vehicle body 37 as shown in FIG. 1 rather than on the engine as is the carburetor. The additional air as metered by the metering device 27 is supplied to the carburetor through the conduits 39, 40 and 41.

The carburetor 22 as shown in FIG. 1 can be of the conventional two-stage type such as that shown in FIGS. 2 and 3. The carburetor is provided with two intake passages 44 and 46 each having a throttle valve 45 and 47, respectively. The main fuel supply system for the passage 44 is shown in FIG. 2 wherein the fuel is supplied from the float chamber 48 to the sump 49 by means of a jet 50. The main air supply for the emulsifier passage 52 enters through the passage 54 and an auxiliary air supply under the control of a metering device 27 is supplied through the passage 56 to the top of the emulsifier passage 52. The conduit 39 is connected to the fitting **56*a* which is secured at the entrance to the passage 56. The fuel-air mixture is then supplied through the passage 57 to the venturi 58 of the passage 44. The fuel supply for the other passage 46 is identical to that shown in FIG. 2 and the conduit 40 would be connected to a fitting similar to 56*a*** in order to provide an auxiliary metered air supply in order to adjust the fuel-air ratio.

The supply of the fuel-air mixture during idle is shown in FIG. 3 wherein the fuel is supplied from the chamber 60 through the passage 61 to the idle jet 68. The primary air supply to the idle jet 68 enters through the passage 69 and an auxiliary metered air supply is also provided to the idle jet through the passage 67 which is provided with a fitting **67*a* to which the conduit 41 would be connected. The fuel-air mixture then passes through the duct 62 and nozzle 63 into the intake passage 44. Thus, the metering device 27 according to the present invention controls the supply of air through the conduits 39, 40 and 41** to the main fuel supply passage of both barrels and to the idle fuel-air supply passage for one of the barrels or stages of the carburetor.

The metering device 27 and the various components thereof are shown in detail in FIGS. 4–18. The metering device 27 is adapted to be mounted to the framework or body of the motor vehicle by means of bolts which may be secured in the threaded apertures 34 of the body of the metering device. The cam 55 of the metering device 27 is mounted for rotation on a shaft 51 secured at one end in the body 52 of the metering device 27. The cam is provided with an axially directed extension 57 adjacent the periphery of the cam which is engagable with the driving fork 56 secured to the shaft of the motor 25 for rotation therewith. By utilizing this arrangement, it is not absolutely necessary that the cam shaft and the motor shaft are exactly coaxial. The cam 25' is also provided with a pin 58 which acts as a stop for the cam 55 by cooperating with a lug 59 extending from the body of the metering device as shown in FIG. 14. The external surface 60' of the cam 55 has an overall spiral configuration as best seen in FIGS. 9 and 13 in order to provide a variable force on the resilient metal plate 80 which is interposed between the cam surface 60' and the ends 85 of the valve members 88. The plate 80 has a general T-shaped configuration as shown in FIG. 17 with an elongated slot 81 through which a clamping screw 82 may extend. A pair of projections **80*a* are provided on the wide end of the plate 80 for engagement with the surface 60' of the cam 55. The plate 80 normally has a curvature as shown in the solid line configuration of FIG. 18 so that the plate will normally be biased against the cam surface. As the cam rotates, the plate 80 will be flexed to the dotted line position as shown in FIG. 18**.

Three identical metering valve units 83 mounted in the body 52 of the metering device 27 as best seen in FIG. 14. One of the units 83 as shown in FIG. 15 will be described in detail. Each unit 83 is comprised of a substantially cylindrical body 84 having a threaded portion 94 so that the unit can be adjustably threaded into the body 52. The outer end of the body 84 is provided with a hexagon portion 92 to facilitate the turning of the body. An O ring 93 of suitable elastomeric material is provided to seal the unit 83 to the body 52 of the metering unit in an air-tight manner. The body 84 is provided with a stepped bore 91 and one end is provided with a fitting 96 for the reception of the respective air conduit 39, 40 or 41. A bushing 86 having an air passage therethrough is fitted in the opposite end of the body 84 and a valve member 88 is located in the chamber 99 within the body 84. The valve member 88 is provided with a tapered conical portion 87 which extends into the apertured bushing 86 and a cylindrical end portion which is adapted to engage the cam operated plate 80. A spring 90 is provided within the chamber 89 for normally biasing the conical portion 87 into seating engagement with the bushing 86 to prevent the flow of air through the apertured bushing 86, the chamber 89 and the passage 91. Thus, as the three conical portions 87 are lifted off the bushings 86 in response to rotation of the cam 55 the increased supply of air to the various passages of the carburetor will result in a leaner fuel-air mixture being supplied to the engine.

In the overall operation of the system, if the mixture delivered by the carburetor 22 is richer than the stoichiometric valve, the sensor 32 will provide a signal to the electronic control circuit 33. The electronic control circuit will then provide a signal to the motor 35 proporational to the difference between a reference signal and the signal from the sensor 32. The motor 35 under this signal will turn through an angle proportional thereto in a clockwise direction as viewed in FIG. 13 to gradually increase the effective radius of the cam. This will result in the displacement of a plate 80 to the right as viewed in FIGS. 13 and 14 to shift the valve members 87 upwardly as viewed in FIG. 15 to increase the area of the annular section of the passage within the bushing 86. The flow of additional air through the enlarged opening will result in a weakening of the mixture delivered by the carburetor. Conversely, if the mixture is leaner than the stoichiometric valve, the cam 55 will be rotated in the opposite direction to decrease the amount of additional air being supplied to the carburetor.

Although three conduits have been shown for connection to the main ducts of each stage and the idling duct of one of the stages, the number of conduits would be varied depending upon the type of carburetor being used. When the carburetor is of the two-stage type with simultaneous throttle opening, there would be a fourth conduit connected to the idling duct of the other stage. Should the carburetor be of the single-stage type, there would only be two flexible conduits, the first being connected to the main duct of the carburetor and the second to the idling duct.

While the invention has been particularly shown and described with reference to a preferred embodiment thereof, it will be understood by those skilled in the art that various changes in form and details may be made therein without departing from the spirit and scope of the invention.

What is claimed is:

1. A system for correcting the fuel-air ratio of the mixture delivered by a carburetor to an internal combustion engine comprising support means, an internal combustion engine mounted on said means, carburetor means on said engine having at least one main fuel-air duct and at least one idle fuel-air duct for supplying a fuel-air mixture to said engine, air filter means for supplying clean air to said carburetor, an exhaust system connected to said engine for the gases produced by said engine including probe means for sensing and providing a signal indicative of the oxygen concentration in said gases, an air metering device mounted on said support means separate from said engine, flexible conduit means supplying air from said air filter means to said device and from said device to said ducts and circuit means responsive to said signal from said probe means for controlling said metering device to correct the fuel-air mixture in response to oxygen concentration in the exhaust gases, said metering device including a plurality of air metering valve means, one for each fuel-air duct in said carburetor, cam means for simultaneously controlling said valve means and stepping motor means connected to said circuit means for rotating said cam means and an air chamber in which said cam means is rotatably mounted, said chamber having an inlet connected to said conduit from said air filter, each of said valve means being adjustably threaded into said device with one end thereof in communication with said chamber and the opposite end thereof connected to one of said ducts and including a valve member normally biased into engagement with a valve seat and having a pin portion protruding into said chamber, said cam means including a rotatable substantially cylindrical cam having a spiral external surface disposed substantially perpendicular to each pin and resilient plate means normally biased into engagement with said cam surface and operatively engaging each pin so that upon rotation of said cam means said valve members will be simultaneously moved relative to their respective seats to vary the air passing through said valve means.

* * * * *